US005330814A

United States Patent [19]

Fewell

[11] Patent Number: 5,330,814

[45] Date of Patent: Jul. 19, 1994

[54] FLEXIBLE PROTECTIVE COVER PAD

[76] Inventor: Takeko N. Fewell, 204 Greenhurst Ave., Summerville, S.C. 29485

[21] Appl. No.: 1,166

[22] Filed: Jan. 7, 1993

[51] Int. Cl.[5] ..... B32B 3/06; B32B 3/08

[52] U.S. Cl. ..... 428/41; 428/77; 428/194; 428/317.1; 428/317.3; 428/906; 52/717.03; 52/717.04; 248/345.1

[58] Field of Search ..... 428/41, 77, 194, 906, 428/317.3, 317.1; 52/717.03, 717.04, 288; 248/345.1

[56] References Cited

U.S. PATENT DOCUMENTS 4,837,062 6/1989 Dunshee et al. ..... 428/41
4,861,636 8/1989 Barnette ..... 428/41
4,929,488 5/1990 Livi ..... 428/192
5,040,684 8/1991 Knowles ..... 206/586
5,065,972 11/1991 Buckshaw et al. ..... 248/345.1

*Primary Examiner*—Alexander S. Thomas
*Attorney, Agent, or Firm*—John R. Flanagan

[57] ABSTRACT

A flexible protective cover pad includes a backing sheet coated on one surface with a layer of adhesive and having a middle portion and a pair of side portions extending along opposite sides of the middle portion, a strip of a flexible foam material moldable to an edge of an object, and a pair of sheets of protective material releasably applied to and peelable from the adhesive-coated surface of the pair of side portions of the backing sheet. The strip of foam-like material has a greater thickness than the backing sheet and a greater width than either of the side portions of the backing sheet.

18 Claims, 1 Drawing Sheet

FLEXIBLE PROTECTIVE COVER PAD

BACKGROUND OF THE INVENTION

1. Field of the Invention

The present invention generally relates to removable furniture guards and, more particularly, is concerned with a flexible protective cover pad.

2. Description of the Prior Art

The household collisions of small children with coffee table corners and other protruding furniture and appliance edges must reverberate through time and space. To avoid the dangers of bodily harm which such accidents can bring to both children and adults, a variety of cushion and bumper devices have been developed over the years.

While meeting some needs in preventing injury to people and article damage as well, significant drawbacks in the prior art include insufficient shock-absorbing capability, difficulty in conforming to furniture surfaces, thus coming undone or falling off, and susceptibility to removal by small children. Many of these drawbacks are answered by recent design improvements. A representative example of one such device is disclosed in U.S. Pat. No. 5,065,972 to Buckshaw et al. The Buckshaw corner bumper provides for significant shock absorption in collisions, as well as improved foldability of bumper flaps for adherence to furniture, and beveled bumper edges to prevent their being picked off by small children.

Despite these advantages, the Buckshaw bumper does have certain limitations, however. This bumper is particularly adaptable for use with furniture corners and edges because of the bumper's design configuration of cylindrical and flap portions. Appliances and other articles with less symmetrical surfaces would be less conducive to contact with the Buckshaw bumper.

Additionally, the rather detailed nature of the Buckshaw design features and the use of both resilient rubber and plastic in constructing the Buckshaw bumper entails the necessity of rather complicated construction involving significant expense in its manufacture.

Consequently, a need still exists for a flexible protective cover pad of simple and inexpensive construction which is readily adaptable for use with a wide range of surface types.

SUMMARY OF THE INVENTION

The present invention provides a flexible protective cover pad designed to satisfy the aforementioned needs by avoiding the drawbacks of the prior art without introducing other drawbacks. Instead, the flexible protective cover pad of the present invention provides expanded capabilities not available in the prior art devices.

One capability is the adaptability of the cover pad to a wide variety of surface types. Such adaptability is based on the moldability of the middle foam strip of the pad and the complete foldability of its flexible side portions.

A second capability is the simplicity of design and of materials used in constructing the cover pad. This simplicity results in a substantial reduction of the cost of fabrication of the cover pad.

A third capability is the simplicity of the process of fabricating the protective cover pad. Cover pads in strip form are fabricated by carrying out three basic steps and then, in a fourth and final step, are cut to individual lengths and packaged or are rolled into a continuous roll in strip form and packaged for sale and distribution.

Accordingly, the present invention is directed to a flexible protective cover pad which comprises: (a) a backing sheet of flexible material having a middle portion and a pair of side portions extending along opposite sides of the middle portion, the backing sheet of flexible material being coated on one surface with an adhesive; (b) an elongated strip of flexible foam-like material being moldable to the shape of an edge of an object to be covered, the strip of foam-like material being applied to adhesive-coated surface of the middle portion of the backing sheet; and (c) a pair of elongated sheets of flexible material for protecting the adhesive-coated surface of the side portions of the backing sheet, the sheets of protective material being releasably applied to and peelable from the adhesive-coated surface of the side portions of the backing sheet.

The strip of foam-like material has a greater thickness than the backing sheet. The strip of foam-like material has a greater width than either of the side portions of the backing sheet. The strip of foam-like material is releasably applied to and peelable from the adhesive-coated surface of the middle portion of the backing sheet. The side portions of the backing sheet extend along opposite sides of the strip of foam-like material.

As stated previously, the foam strip adhering to the middle portion of the backing sheet is moldable to a variety of shapes, including furniture and appliance corners and edges, metal and wood trims on objects, hard objects, round and oval shapes, etc. The adhesive-coated plastic side portions are foldable to virtually any angle of an object to firmly secure the foam strip of the cover pad in place over the surface portion to be covered.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
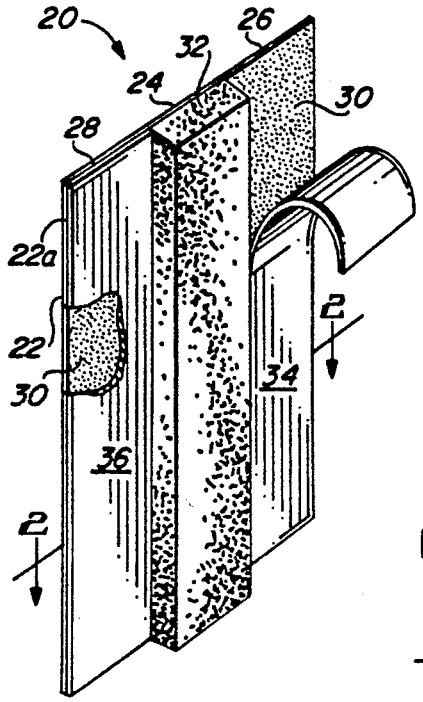
FIG. 1 is a perspective view of a flexible protective cover pad of the present invention.
Figure 2:
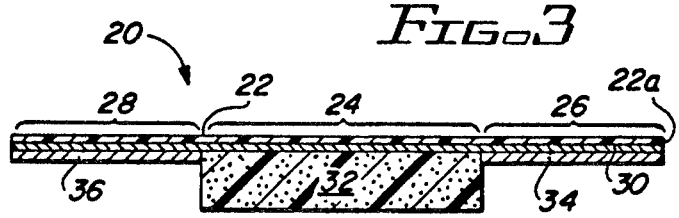
FIG. 2 is an enlarged cross-sectional view of the protective cover pad taken along 2—2 of FIG. 1.
Figure 4:
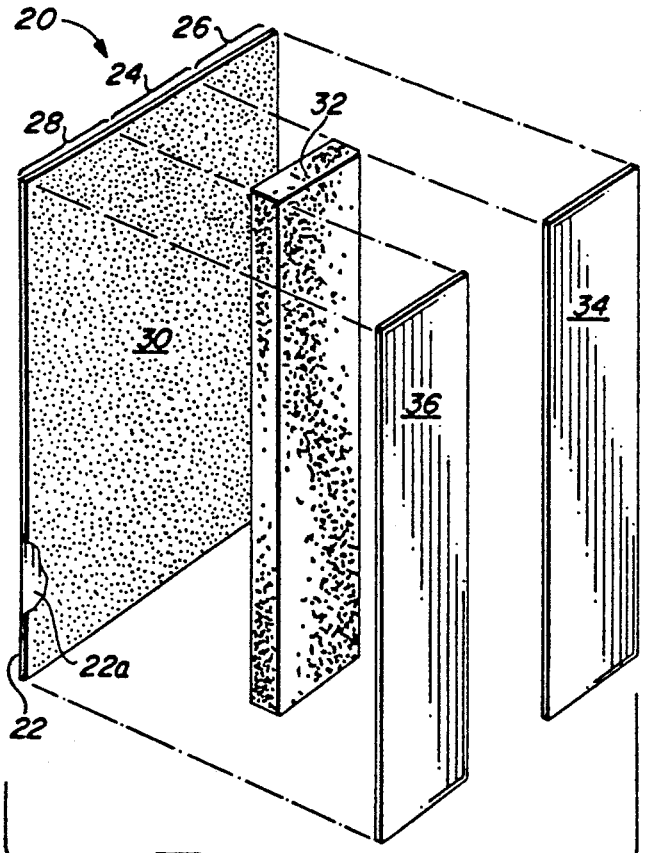
FIG. 4 is an exploded perspective view of the protective cover pad of FIG. 1.

Referring to the drawings and particularly to FIGS. 1, 2 and 4, there is illustrated a flexible protective cover pad of the present invention, being generally designated 20. In its basic components, the flexible protective cover pad 20 includes a backing sheet 22 formed from a planar or flat blank of a suitable thin plastic material, such as vinyl. The backing sheet 22 has a middle portion 24 and a pair of side portions 26, 28 extending along opposite sides of the middle portion 24, as seen in FIGS. 2 and 4. The backing sheet 22 is coated on one surface 22*a* with a layer of a suitable adhesive substance 30, such as a pressure-sensitive adhesive substance. Thus, the middle portion 24 and each of the side portions 26, 28 on planar surface 22*a* of the backing sheet 22 are coated with the adhesive coating or layer 30.

The flexible protective cover pad 20 also includes an elongated strip of a pliable flexible foam-like material 32 of a suitable material, such as styrofoam, which is releasably applied to and peelable from the adhesive-coated surface of middle portion 24 of backing sheet 22. This strip of foam material 32 can be molded to the shape of a wide variety of surface features. The strip of foam material 32 has a greater thickness than the backing sheet 22 and preferably a greater width than either of the side portions 26, 28 of the backing sheet 22.

Finally, the cover pad 20 includes a pair of sheets of material 34, 36 which are releasably applied to and peelable from the adhesive-coated surface of the pair of side portions 26, 28 of backing sheet 22. The material of the sheets 34, 36 is any suitable material, such as a plastic coated paper, capable of protecting the adhesive-coated surfaces of the side portions 26, 28 of the backing sheet 22 to avoid premature deterioration of the adhesiveness thereof. The backing sheet 22 has a greater thickness than either of the sheets of protective material 34, 36.

Figure 3:
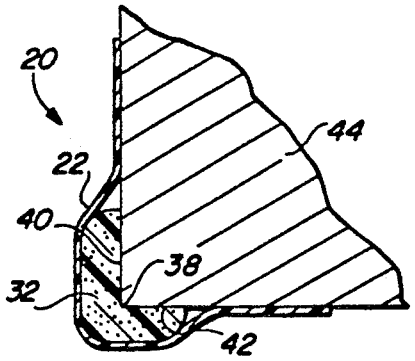
FIG. 3 is an enlarged sectional view of the protective cover pad applied to a corner of an article of furniture.

Referring particularly to FIG. 3, there is shown a typical use of the flexible protective cover pad 20 wherein the foam strip 32 is molded around the sharp edge or corner 38 and intersecting sides 40, 42 of an article of furniture 44. The protective sheets 34, 36 having been peeled off side portions 26, 28 of backing sheet 22, the side portions 26, 28 are then folded to meet and adhere snugly and smoothly to the corresponding sides 40, 42 of the furniture article 44.

In a similar fashion the flexible protective cover pad 20 can be affixed to any type of corners or edges on furniture or other types of objects regardless of the object's shape, as the foam strip 32 is moldable or deformable to cover any type of shape and the adhesive-coated side portions 26, 28 of the backing sheet 22 are foldable to any angle necessary to secure the foam strip 32 in place. Additionally, the cover pad 20 can be used for household purposes such as forming handles, grips, or for temporary repair of vinyl car upholstery. Where necessary, a portion of the foam strip 32 can be peeled off from the middle portion 24 so that the side portions 26, 28 can join smoothly with the remainder of the middle portion 24 in securing the cover pad 20 in place over a particular object.

Additionally, the backing sheet 22 is producible in a variety of colors so that the cover pad 20 will blend harmoniously with the particular color of the object to be covered. Some examples, walnut or mahogany colors for furniture, as well as other colors and clear vinyl. One further feature of the cover pad 20 is the complete removability of the cover pad 20 from an object's surface, as desired, by simple finger pressure pulling the side portions 26, 28 of cover pad 20 away from the covered object. This complete removal of cover pad 20 includes removal of the adhesive layer 30 coating the side portions 26, 28 as well, such that no adhesive is left clinging to the now uncovered surface.

Figure 5:
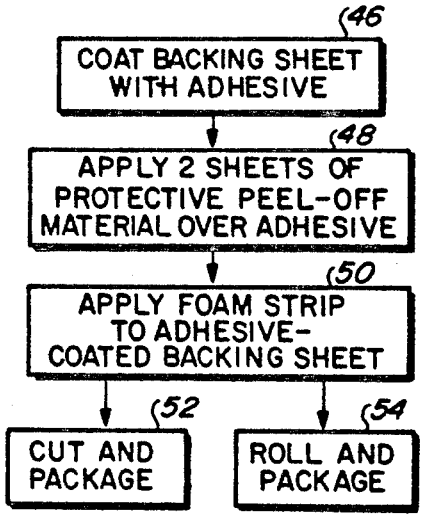
FIG. 5 is a flow diagram of process steps for fabrication of the protective cover pad of FIG. 1.

Referring to the flow diagram of FIG. 5, there is outlined the particular process steps for fabrication of the flexible protective cover pad 20 in the preferred embodiment. First, as per block 46, the planar surface 22*a* of the backing sheet 22 is coated with the layer of adhesive 30. Next, as per block 48, the two sheets of protective peel-off material 34, 36 are applied over the adhesive layer 30 on side portions 26, 28 of backing sheet 22. Thirdly, as per block 50, the elongated foam strip 32 is applied over adhesive layer 30 to the middle portion 24 of backing sheet 22 between the spaced protective sheets 34, 36. As per block 52, the finished continuous strip so formed can then be cut into individual cover pads 20 at whatever lengths deemed marketable and packaged for sale.

Figure 6:
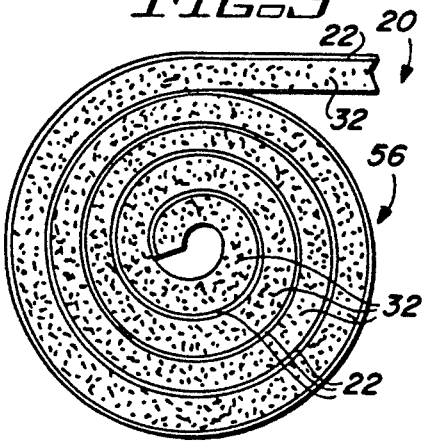
FIG. 6 is a side elevational view of a continuous roll in strip form from which individual protective cover pads can be cut off.

Alternatively, referring to FIGS. 5 and 6, the finished continous strip can be wound, as per block 54 of FIG. 5, into a roll 56 of multiple flexible protective cover pads in a continuous strip of a desired length from which individual flexible protective cover pads 20 can be cut off at whatever lengths desired by the purchaser.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

I claim:

1. A flexible protective cover pad, comprising:

(a) a backing sheet of flexible material having a middle portion and a pair of side portions extending along opposite sides of the middle portion, said backing sheet of flexible material being coated on one surface with an adhesive;

(b) an elongated strip of flexible foam-like material being moldable to the shape of an edge of an object to be covered, said strip of foam-like material being applied to adhesive-coated surface of said middle portion of said backing sheet, said strip of foam-like material having a greater thickness than said backing sheet; and (c) a pair of elongated sheets of flexible material for protecting said adhesive-coated surface of said side portions of said backing sheet, said sheets of protective material being releasably applied to and peelable from said adhesive-coated surface of said side portions of said backing sheet.

2. The cover pad of claim 1 wherein said strip of foam-like material is releasably applied to and peelable from said adhesive-coated surface of said middle portion of said backing sheet.

3. The cover pad of claim 1 wherein said side portions of said backing sheet extend along opposite sides of said strip of foam-like material.

4. The cover pad of claim 1 wherein said strip of foam-like material is styrofoam.

5. The cover pad of claim 1 wherein said material of said backing sheet is vinyl.

6. The cover pad of claim 1 wherein said side portions of said backing sheet are foldable to adhere to any angle of the edge of the object.

7. The cover pad of claim 1 wherein said backing sheet is producible in any one of a variety of colors to blend with the color of the object to be covered.

8. The cover pad of claim 1 wherein said adhesive coating on said backing sheet is substantially removed from the covered object upon removal of said cover pad from the object.

9. A wound roll of multiple flexible protective cover pads in continuous strip form from which individual flexible protective cover pads can be severed, each of said cover pads comprising:

(a) a backing sheet of flexible material having a middle portion and a pair of side portions extending along opposite sides of the middle portion, said backing sheet of flexible material being coated on one surface with an adhesive;

(b) an elongated strip of flexible foam-like material being moldable to the shape of an edge of an object to be covered, said strip of foam-like material being applied to adhesive-coated surface of said middle portion of said backing sheet, said strip of foam-like material having a greater thickness than said backing sheet; and (c) a pair of elongated sheets of flexible material for protecting said adhesive-coated surface of said side portions of said backing sheet, said sheets of protective material being releasably applied to and peelable from said adhesive-coated surface of said side portions of said backing sheet.

10. The cover pad roll of claim 9 wherein said strip of foam-like material is releasably applied to and peelable from said adhesive-coated surface of said middle portion of said backing sheet.

11. The cover pad roll of claim 9 wherein said side portions of said backing sheet extend along opposite sides of said strip of foam-like material.

12. The cover pad roll of claim 9 wherein said strip of foam-like material is styrofoam.

13. The cover pad roll of claim 9 wherein said material of said backing sheet is vinyl.

14. The cover pad roll of claim 9 wherein said side portions of said backing sheet are foldable to adhere to any angle of the edge of the object.

15. The cover pad roll of claim 9 wherein said backing sheet is producible in any one of a variety of colors to blend with the color of the object to be covered.

16. The cover pad roll of claim 9 wherein said adhesive coating on said backing sheet is substantially removed from the covered object upon removal of said cover pad from the object.

17. A flexible protective cover pad, comprising:

(a) a backing sheet of flexible material having a middle portion and a pair of side portions extending along opposite sides of the middle portion, said backing sheet of flexible material being coated on one surface with an adhesive;

(b) an elongated strip of flexible foam-like material being moldable to the shape of an edge of an object to be covered, said strip of foam-like material being applied to adhesive-coated surface of said middle portion of said backing sheet, said strip of foam-like material having a greater width than either of said side portions of said backing sheet; and (c) a pair of elongated sheets of flexible material for protecting said adhesive-coated surface of said side portions of said backing sheet, said sheets of protective material being releasably applied to and peelable from said adhesive-coated surface of said side portions of said backing sheet.

18. A wound roll of multiple flexible protective cover pads in continuous strip form from which individual flexible protective cover pads can be severed, each of said cover pads comprising:

(a) a backing sheet of flexible material having a middle portion and a pair of side portions extending along opposite sides of the middle portion, said backing sheet of flexible material being coated on one surface with an adhesive;

(b) an elongated strip of flexible foam-like material being moldable to the shape of an edge of an object to be covered, said strip of foam-like material being applied to adhesive-coated surface of said middle portion of said backing sheet, said strip of foam-like material having a greater width than either of said side portions of said backing sheet; and (c) a pair of elongated sheets of flexible material for protecting said adhesive-coated surface of said side portions of said backing sheet, said sheets of protective material being releasably applied to and peelable from said adhesive-coated surface of said side portions of said backing sheet.

* * * * *